US006929076B2

(12) United States Patent
Fanuel et al.

(10) Patent No.: US 6,929,076 B2
(45) Date of Patent: Aug. 16, 2005

(54) BORE HOLE UNDERREAMER HAVING EXTENDIBLE CUTTING ARMS

(75) Inventors: Philippe Fanuel, Brussels (BE); Jean-Pierre Lassoie, Brussels (BE); Stein Erik Moi, Hommersaak (NO); Clint Smith, Cypress, TX (US)

(73) Assignee: Security DBS NV/SA, Drogenbos (BE)

( * ) Notice: Subject to any disclaimer, the term of this patent is extended or adjusted under 35 U.S.C. 154(b) by 129 days.

(21) Appl. No.: 10/387,770

(22) Filed: Mar. 13, 2003

(65) Prior Publication Data

US 2004/0065479 A1 Apr. 8, 2004

Related U.S. Application Data

(63) Continuation of application No. 10/264,761, filed on Oct. 4, 2002.

(51) Int. Cl.[7] ..... E21B 10/32

(52) U.S. Cl. ..... 175/267; 175/269; 175/290; 175/325.2

(58) Field of Search ..... 175/269, 263, 175/267, 268, 287, 276, 278, 290, 325.2, 325.5

(56) References Cited

U.S. PATENT DOCUMENTS

| | | | |
|---|---|---|---|
| 336,187 A | 2/1886 | Wells | |
| 1,411,484 A | 4/1922 | Fullilove | |
| 1,454,843 A | 5/1923 | Brown | |
| 1,485,642 A | 3/1924 | Stone | |
| 1,607,662 A | 11/1926 | Boynton | |

(Continued)

FOREIGN PATENT DOCUMENTS

| | | | |
|---|---|---|---|
| BE | 1012545 A3 | 12/2000 | |
| DE | 2839868 | 4/1979 | ..... E21C/19/00 |
| EP | 0086701 | 8/1983 | ..... E21B/10/32 |
| EP | 0 301 890 | 2/1989 | ..... E21B/10/32 |
| EP | 0577545 A1 | 3/1993 | ..... E21B/10/32 |

(Continued)

OTHER PUBLICATIONS

Notification of International Search Report and Written Opinion for International Application No. PCT/BE2004/000057, filed Apr. 21, 2004 (11 pages), Dec. 21, 2004.

Notification of International Search Report and Written Opinion for International Application No. PCT/BE2004/000083, filed Jun. 9, 2004 (11 pages), Dec. 21, 2004.

PCT International Preliminary Examination Report PCT/BE02/00031, Jun. 17, 2003.

Search Report issued in Belgian Patent Application No. 2003/00521, mailed Oct. 5, 2004.

International Search Report mailed for International Application No. PCT/BE02/00031, filed Mar. 7, 2002 (7 pages), May 16, 2002.

UK Search Report for Great Britain Patent Application No.: GB 0323195.8 from Examiner Bob Crowshaw (1 page), Dec. 11, 2003.

Notification of Transmittal of International Search Repot mailed May 7, 2002 corresponding to International Application No. PCT/BE02/00031.

*Primary Examiner*—Hoang Dang
(74) *Attorney, Agent, or Firm*—Baker Botts L.L.P.

(57) ABSTRACT

A bore hole underreamer is provided having a hollow body with a longitudinal axis, which has an external wall, at least two cylindrical bores provided through the external wall and whose axes are transverse to the longitudinal axis. Each of the bores have a cylindrical widening arm for widening the hole, which is arranged in the bore like a hydraulic piston, so as to be able to slide therein between an active position and an inactive position. The underreamer has a locking member which can occupy a locking position in which this member locks the arms in their inactive position, and which, when it is released, can leave the locking position under a thrust from at least one of the arms subjected to the pressure capable of pushing the arm into its active position.

21 Claims, 6 Drawing Sheets

U.S. PATENT DOCUMENTS

| | | | | | |
|---|---|---|---|---|---|
| 1,631,449 | A | | 6/1927 | Alford | |
| 1,671,474 | A | | 5/1928 | Jones | |
| 1,686,403 | A | | 10/1928 | Boyonton | |
| 1,772,710 | A | | 8/1930 | Denney | |
| 1,804,850 | A | | 5/1931 | Triplett | |
| 1,878,260 | A | | 9/1932 | Bunker | |
| 2,060,352 | A | | 11/1936 | Stokes | 255/75 |
| 2,169,502 | A | | 8/1939 | Santiago | 255/76 |
| 2,239,996 | A | | 4/1941 | Chappell | 255/74 |
| 2,271,472 | A | | 1/1942 | Balduf | 72/115 |
| 2,427,052 | A | | 9/1947 | Grant | 255/74 |
| 2,438,673 | A | | 3/1948 | McMahan | 166/18 |
| 2,450,223 | A | | 9/1948 | Barbour | 175/271 |
| 2,499,916 | A | * | 3/1950 | Harris | 175/267 |
| 2,710,172 | A | * | 6/1955 | Kammerer, Jr. | 175/271 |
| 2,754,089 | A | | 7/1956 | Kammerer, Jr. | 255/76 |
| 2,758,819 | A | | 8/1956 | Kammerer, Jr. | 255/76 |
| 2,809,015 | A | | 10/1957 | Phipps | 255/75 |
| 2,822,150 | A | | 2/1958 | Muse et al. | 255/76 |
| 2,834,578 | A | | 5/1958 | Carr | 255/73 |
| 2,872,160 | A | | 2/1959 | Barg | 255/76 |
| 2,882,019 | A | | 4/1959 | Carr et al. | 255/73 |
| 3,105,562 | A | * | 10/1963 | Stone et al. | 175/268 |
| 3,123,162 | A | | 3/1964 | Rowley | |
| 3,180,436 | A | | 4/1965 | Kellner et al. | 175/57 |
| 3,224,507 | A | | 12/1965 | Cordary et al. | 166/55.8 |
| 3,351,144 | A | | 11/1967 | Park | 175/269 |
| 3,365,010 | A | | 1/1968 | Howell et al. | 175/286 |
| 3,425,500 | A | | 2/1969 | Fuchs | 175/269 |
| 3,433,313 | A | | 3/1969 | Brown | 175/270 |
| 3,556,233 | A | | 1/1971 | Gilreath et al. | 175/267 |
| 3,749,184 | A | | 7/1973 | Andeen | 175/18 |
| 3,974,886 | A | | 8/1976 | Blake, Jr. | 175/76 |
| 4,055,226 | A | | 10/1977 | Weber | 175/273 |
| 4,081,042 | A | | 3/1978 | Johnson et al. | 175/267 |
| 4,091,883 | A | * | 5/1978 | Weber | 175/287 |
| 4,141,421 | A | | 2/1979 | Gardner | 175/263 |
| 4,177,866 | A | | 12/1979 | Mitchell | 175/53 |
| 4,186,810 | A | | 2/1980 | Allan | 175/96 |
| 4,190,124 | A | | 2/1980 | Terry | 175/406 |
| 4,458,761 | A | | 7/1984 | Van Vreeswyk | 166/289 |
| 4,503,919 | A | | 3/1985 | Suied | 175/269 |
| 4,589,504 | A | | 5/1986 | Simpson | 175/267 |
| 4,660,657 | A | | 4/1987 | Furse et al. | 175/269 |
| 4,821,817 | A | | 4/1989 | Cendre et al. | 175/269 |
| 4,842,083 | A | | 6/1989 | Raney | 175/325 |
| 4,889,197 | A | | 12/1989 | Bøe | 175/267 |
| 4,915,181 | A | | 4/1990 | Labrosse | 175/263 |
| 5,010,967 | A | | 4/1991 | Desai | 175/406 |
| 5,036,921 | A | | 8/1991 | Pittard et al. | 166/298 |
| 5,060,738 | A | | 10/1991 | Pittard et al. | 175/267 |
| 5,086,852 | A | * | 2/1992 | van Buskirk | 175/269 |
| 5,139,098 | A | | 8/1992 | Blake | 175/269 |
| 5,184,687 | A | | 2/1993 | Abdrakhmanov et al. | 175/267 |
| 5,255,741 | A | | 10/1993 | Alexander | 166/278 |
| 5,265,684 | A | | 11/1993 | Rosenhauch | 175/61 |
| 5,271,472 | A | | 12/1993 | Leturno | 175/107 |
| 5,318,137 | A | | 6/1994 | Johnson et al. | 175/40 |
| 5,318,138 | A | | 6/1994 | Dewey et al. | 175/74 |
| 5,330,016 | A | * | 7/1994 | Paske et al. | 175/320 |
| 5,332,048 | A | | 7/1994 | Underwood et al. | 175/26 |
| 5,348,095 | A | | 9/1994 | Worrall et al. | 166/380 |
| 5,368,114 | A | | 11/1994 | Tandberg et al. | 175/267 |
| 5,560,440 | A | | 10/1996 | Tibbitts | 175/384 |
| 5,590,724 | A | | 1/1997 | Verdgikovsky, deceased | 175/57 |
| 5,655,609 | A | | 8/1997 | Brown et al. | 175/76 |
| 5,788,000 | A | | 8/1998 | Maury et al. | 175/325.1 |
| 5,957,222 | A | | 9/1999 | Webb et al. | 175/45 |
| 5,957,226 | A | | 9/1999 | Holte | 175/320 |
| 6,059,051 | A | * | 5/2000 | Jewkes et al. | 175/76 |
| 6,070,677 | A | | 6/2000 | Johnston, Jr. | 175/57 |
| 6,131,675 | A | | 10/2000 | Anderson | 175/268 |
| 6,189,631 | B1 | | 2/2001 | Sheshtawy | 175/284 |
| 6,209,665 | B1 | | 4/2001 | Holte | 175/273 |
| 6,213,226 | B1 | | 4/2001 | Eppink et al. | 175/61 |
| 6,244,664 | B1 | | 6/2001 | Ebner et al. | 299/80.1 |
| 6,269,893 | B1 | | 8/2001 | Beaton et al. | 175/391 |
| 6,289,999 | B1 | | 9/2001 | Dewey et al. | 175/38 |
| 6,360,830 | B1 | | 3/2002 | Price | 175/52 |
| 6,360,831 | B1 | | 3/2002 | Åkesson et al. | 175/269 |
| 6,378,632 | B1 | | 4/2002 | Dewey et al. | 175/269 |
| 6,419,025 | B1 | | 7/2002 | Lohbeck et al. | 166/380 |
| 6,427,788 | B1 | | 8/2002 | Rauchenstein | 175/269 |
| 6,464,024 | B2 | | 10/2002 | Beaton et al. | 175/391 |
| 6,668,949 | B1 | | 12/2003 | Rives | 175/269 |
| 6,732,817 | B2 | | 5/2004 | Dewey et al. | 175/57 |
| 2003/0079913 | A1 | | 5/2003 | Eppink et al. | 175/61 |
| 2003/0155155 | A1 | | 8/2003 | Dewey et al. | 175/57 |
| 2004/0134687 | A1 | | 7/2004 | Radford et al. | 175/57 |

FOREIGN PATENT DOCUMENTS

| | | | | |
|---|---|---|---|---|
| EP | 0 568 292 | A1 | 11/1993 | E21B/37/02 |
| FR | 569203 | | 4/1924 | |
| GB | 218774 | | 7/1924 | |
| GB | 0295150 | | 8/1928 | |
| GB | 540027 | | 10/1941 | |
| GB | 1586163 | | 3/1981 | E21B/10/26 |
| GB | 2128657 | A | 5/1984 | E21B/10/32 |
| GB | 2 128 657 | A | 5/1984 | E21B/10/32 |
| GB | 2 180 570 | A | 4/1987 | E21B/10/34 |
| NL | 8503371 | | 7/1987 | E21B/17/10 |
| WO | WO 00/31371 | | 6/2000 | E21B/10/31 |
| WO | 00/31371 | | 6/2000 | E21B/10/32 |
| WO | 02/072994 | A1 | 9/2002 | E21B/10/32 |

* cited by examiner

BORE HOLE UNDERREAMER HAVING EXTENDIBLE CUTTING ARMS

RELATED APPLICATIONS

This application is a Continuation-In-Part of U.S. patent application Ser. No. 10/264,761, entitled Bore Hole Underreamer, filed Oct. 4, 2002.

TECHNICAL FIELD OF THE INVENTION

The present invention relates generally to underground drilling equipment, and more particularly to a bore hole underreamer having extendible cutting arms.

BACKGROUND OF THE INVENTION

Underreamers are typically used to enlarge the diameter of a bore hole, for one or more of a variety of reasons. It is often necessary for the underreamer to first travel through a casing(s), having a diameter smaller than the diameter desired down-hole of the casing. Accordingly, underreamers are provided with cutting arms that may be retracted during travel through the casing. When a predetermined depth is reached, the cutting arms are actuated to an extended position, and drilling with the underreamer commences. Before an underreamer is brought into service on each occasion, it may be necessary that each arm be locked distinctly in the inactive position. This is to prevent the arms from being deployed unintentionally following variations in the pressure of the fluid passing through the underreamer, until particular time and/or depth chosen by the operator. In particular therefore, for each new use of a typical underreamer, it is often necessary to remove each arm on each occasion, and possibly the housing thereof, in order to renew the distinct locking means.

In addition, this type of equipment is subjected to very harsh forces under working conditions that are known to be very difficult and therefore very expensive. Firstly, an equipment breakdown may cost significant time, money and resources in attempting to save the equipment, for example jammed at a great depth, and in particular saving the bore hole made at great expense and which, otherwise, could be definitively condemned. Secondly, when the equipment is recovered, an equipment breakdown must be able to be repaired very easily because the technical repair means available on or close to a drilling platform are sometimes limited.

SUMMARY OF THE INVENTION

The present invention provides an underreamer having extendible arms that can simply and securely be extended to a predetermined position with respect to a body of the underreamer. Such an underreamer may be used to enlarge an existing bore hole, for example to increase the existing diameter by 1.2 times (or more) the existing diameter. The underreamer is particularly suited for coupling with a drill head, and accommodates high flow rate drilling applications, without introducing substantial pressure drop to the well.

In accordance with a particular embodiment of the present invention, an underreamer includes a generally cylindrical body defining a longitudinal bore at least partially therethrough, and at least first and second peripheral bores extending generally from the longitudinal bore to an external surface of the body. First and second cutting arms may be disposed at least partially within the first and second peripheral bores. Each cutting arm is extendible from a first position in which the cutting arm is generally flush or recessed with respect to the external surface, to a second position in which the cutting arm is extended with respect to the external surface. A removable stop may be disposed within a cavity that extends generally from the external surface to the longitudinal bore, the removable stop extending at least partially into the longitudinal bore and being operable to limit longitudinal movement of the cutting arms beyond a maximum extended position of the cutting arms.

In accordance with another embodiment of the invention, a locking member is disposed within the longitudinal bore, and operable to maintain the cutting arms in their first positions unless a maximum fluid pressure within the longitudinal bore is exceed. The locking member may be fixed to the hollow body in a releasable manner, by a breakable pin calibrated for this purpose. The hollow body may have, in order to receive the breakable pin, a housing opening out on the external periphery of the body.

The locking member may be arranged so as to slide axially in the hollow body, from its locking position, under the thrust of the arms, and has, seen along its axis and on the side of the arms, an end face which co-operates with a support face for each arm for locking it.

According to another embodiment, the underreamer may include a common prestressed spring system arranged so as to return the arms to the inactive position when the pressure of the fluid is below a given value. The spring system may act on the arms by means of the locking member in order to return these to the inactive position.

A selection may be made of the inside and outside diameters of the hollow body, of an axial length of the arms and of their shape so that the complete arms can be installed in their respective bores whilst passing through the inside of the hollow body. In particular, there is provided for this purpose, in one end of the body, on the downstream side following the direction of drilling and a direction of flow of the fluid in the body, a threaded hole with a diameter greater than the diameter of an external thread at the end of the body on the upstream side. There can then be provided an adaptation piece with a male thread, for this threaded hole with a greater diameter, and with a female thread, matching the said external thread, in order to receive a normal bit.

According to yet another embodiment, the underreamer of the invention has an internal piece removably fixed in the hollow body, downstream of the arms, and having, on the side turned towards the arms, for each of these, a guidance groove with two parallel sides parallel to the longitudinal axis, the sides being arranged to co-operate with two parallel edges carried by each of the arms, in order to prevent rotation thereof around their axes. The groove has a length, width and depth corresponding to the two edges and to a travel, which they make between the active and inactive positions of the associated arm.

According to still another embodiment, each arm has a cutting end, disposed on the external side of the hollow body and provided with carbide inserts, or "blades" for enlarging the hole. Each arm may be arranged in the bore like a hydraulic piston, so as to be able to slide therein in the direction of its axis between an active position in which this cutting end is distant from the hollow body, in order to effect an enlarging of the hole, and an inactive position at least close to, or flush with, the external periphery of the hollow body or retracted therein. The other end of the arm, inside the hollow body, is intended to receive from a drilling fluid, circulating in the hollow body, a pressure capable of pushing the said arm into its active position.

The cutting arms may be disposed within generally cylindrical sleeves that extend from the longitudinal bore, to an external surface of the body. The sleeves may be provided with respective shoulders, which co-operate with correspondingly shaped portions of the body, to retain the sleeves within the body. Accordingly, the sleeves may include increased diameter portions adjacent the external surface, in order to prevent movement of the sleeves toward the external surface.

In this context, one aim of the invention is to procure an underreamer of simple design and reliable operation, whose arms can be locked easily and rapidly in the inactive position, and therefore without significant dismantling, and which is composed of a reduced number of parts assembled robustly, easily and rapidly dismantled and exchanged when needed.

Technical advantages of particular embodiments of the present invention include an underreamer that has, for the underreaming arms, a common locking member which can occupy a locking position in which this member locks the arms in their inactive position, which is immobilized in the hollow body, in a releasable manner, in the locking position, in particular before use of the underreamer, and which, when it is released, can leave the said locking position under a thrust of at least one of the arms subjected to the pressure capable of pushing the said arm into its active position.

Other technical advantages will be readily apparent to one skilled in the art from the following figures, descriptions and claims. Moreover, while specific advantages have been enumerated above, various embodiments may include all, some or none of the enumerated advantages.

DETAILED DESCRIPTION OF THE INVENTION

Figure 1:
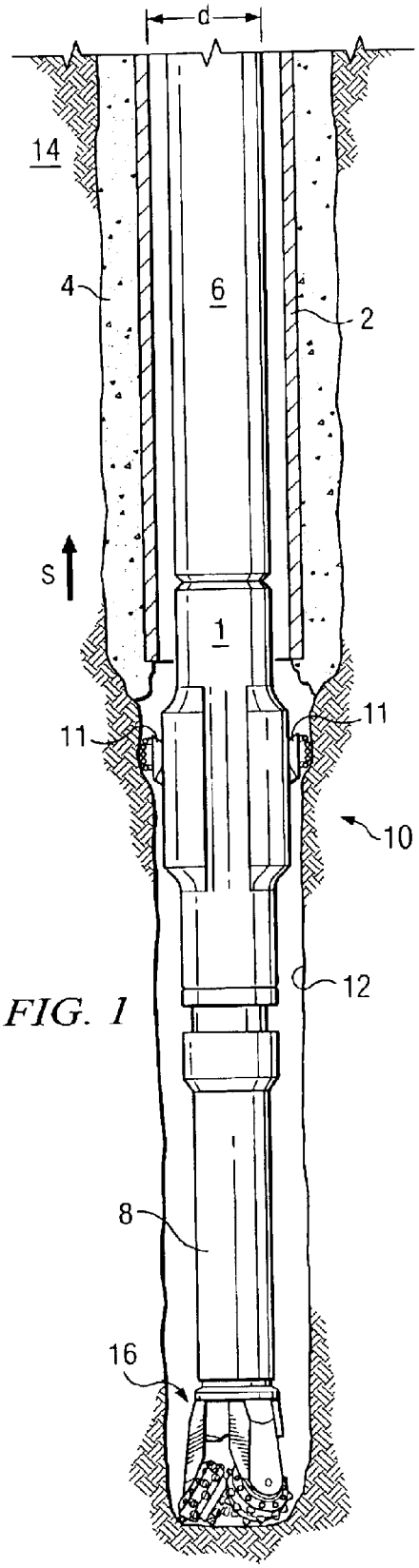
FIG. 1 illustrates an underreamer incorporating aspects of the present invention, disposed within a bore hole of a terrestrial formation.

FIG. 1 illustrates an underreamer 10 disposed within a bore hole 12 in a terrestrial formation 14. Underreamer 10 is coupled with a drill string 6 and/or other optional components that help control rotation, fluid delivery and/or other control functions regarding the operation of underreamer 10. In accordance with a particular embodiment of the present invention, underreamer 10 may be used for oil and gas drilling, as well as other applications. In the illustrated embodiment, underreamer 10 is coupled with a drill head 16, using a drill string 8. Underreamer 10 may be used to enlarge the diameter of an existing bore hole, to a size larger than drill head 16 is capable of achieving.

Underreamer 10 includes an elongate, generally cylindrical body 1 and a plurality of enlarging arms 11 that may be manipulated from a first, retracted position in which the enlarging arms 11 are recessed with respect to cylindrical body 1, to a second, extended position in which enlarging arms 11 extend outwardly, with respect to cylindrical body 1. Accordingly, with its enlarging arms 11 in the retracted position, underreamer 10 includes a relatively thin profile, and may be run through a casing 2. Casing 2 has a generally fixed diameter "d", and is secured within bore hole 12 using concrete 4. After passing through casing 2, enlarging arms 11 may be actuated to their respective extended positions, in order to enlarge the diameter of bore hole 12, at selected locations, to a diameter greater than diameter "d" of the casing. For example, in accordance with a particular embodiment of the present invention, underreamer 10 may be used to increase the diameter of bore hole 12 to approximately 1.2 times the diameter of casing 2.

Figure 2A:
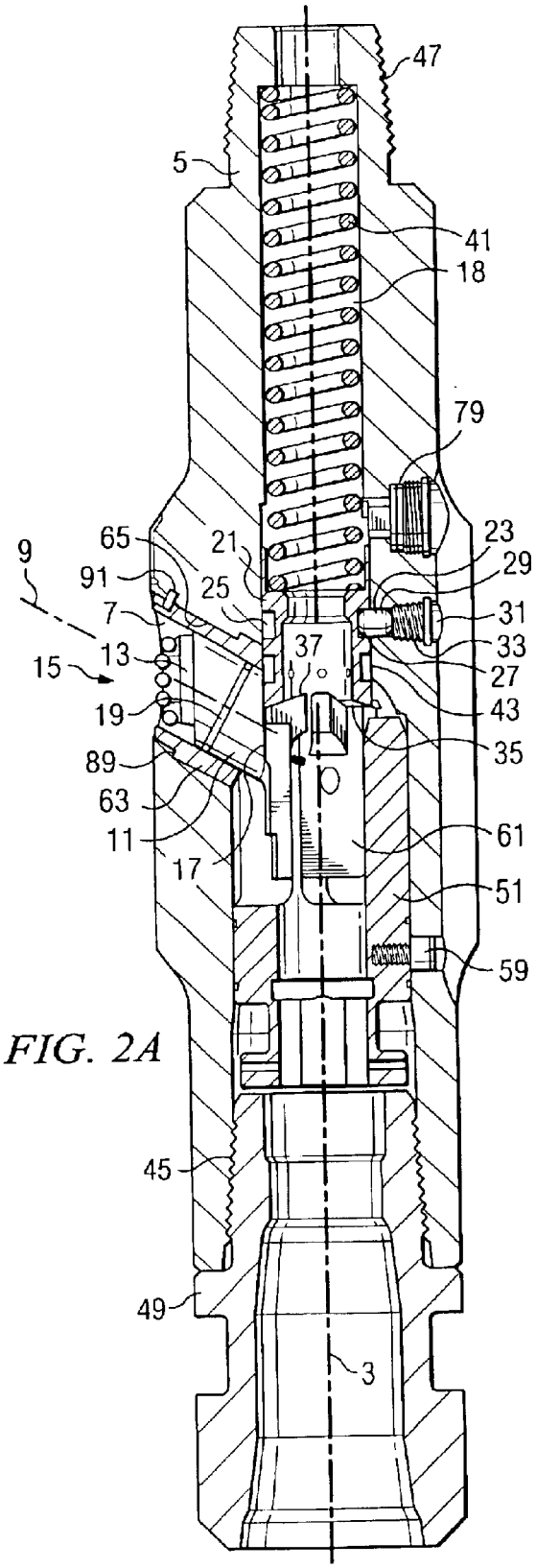
FIGS. 2A and 2B are schematic views in elevation and axial section of an underreamer according to the invention, in which the arms are in the inactive position.
Figure 2B:
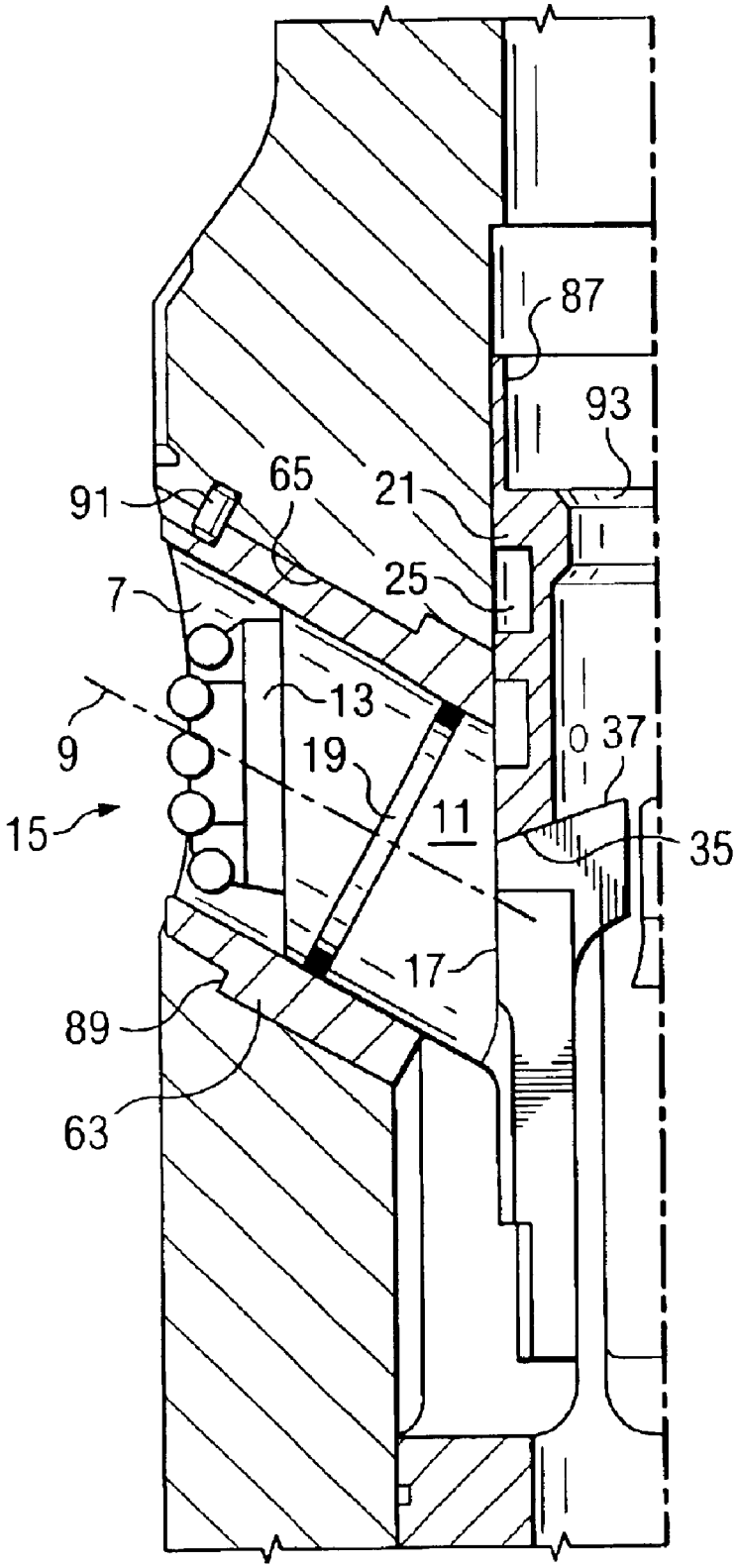
Figure 3:
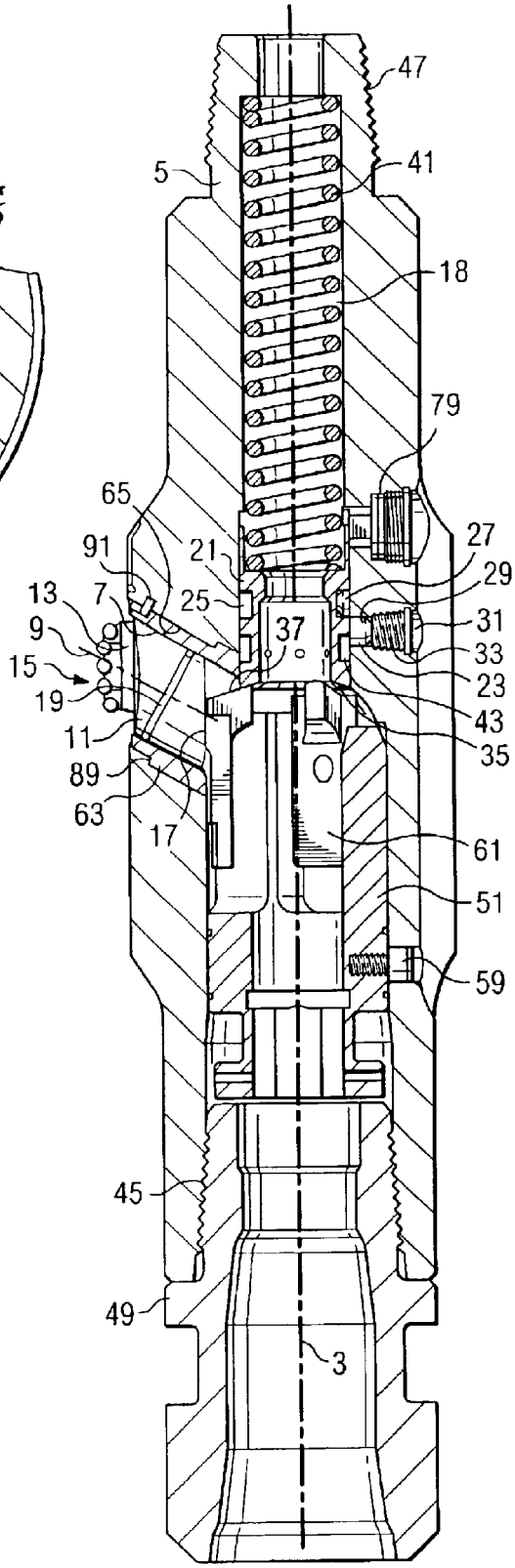
FIG. 3 is a schematic half-view in elevation and section of the same underreamer in which the arms are in the active position.

FIGS. 2A–B and 3 are cross sections through portions of underreamer 10, which illustrate additional components and the operation of enlarging arms 11, in more detail. In FIG. 2, enlarging arms 11 are in the first, retracted position. In FIG. 3, enlarging arms 11 are in the second, extended position. A comparison between the relative positions of components in FIGS. 2A–B and 3 provides a better understanding of the operation and interrelation of such components, as well as the overall operation of underreamer 10.

Underreamer 10 includes a hollow, cylindrical body 1, which extends generally along a longitudinal axis 3. A perimeter, external wall 5 of body 1 defines a central bore 18 through body 1, and is configured to receive a pressurized drilling fluid therethrough. At least two, generally cylindrical, peripheral bores 7 are provided through the external wall 5 and their respective axes 9 are generally transverse to longitudinal axis 3. The bores 7 are distributed over the circumference of the hollow body 1, usually at angular distances which are equal to each other over the circumference but, if the circumstances so justify, these angular distances may be unequal. In addition, in the various figures (in particular in the transverse sections) the various arms 11 are shown as being situated longitudinally at the same level in the body. The teachings of the present invention are not limited to this arrangement; arms 11 may also be arranged such that one or more of the arms occur at a different level(s), or elevation(s), with respect to others.

A respective enlarging arm 11 is disposed within each of the bores 7. Each enlarging arm 11 includes a cutting end 13 disposed adjacent an external surface of hollow body 1. Blades 15 are coupled with cutting ends 13, and are operable to enlarge the bore hole during operation. In the illustrated embodiment, enlarging arms 11 perform a cutting operation to remove material along the sides of bore hole 12. However, it will be recognized by those of ordinary skill in the art that blades and/or cutting surfaces are not required, and that stabilizer arms may be used in lieu of enlarging arms 11, within the teachings of the present invention. For the purposes of this specification, reference to arms should be understood to mean components that accommodate cutting tools and/or stabilizer accessories. Stabilizer accessories refers to those components that are used to center, align, hold in place and/or grip the surface of the well bore and/or casing, when the arms are in their extended positions.

Each arm 11 is arranged in the bore 7 in a similar manner to a hydraulic piston, so as to be able to slide therein in the direction of its axis 9, common to that of the bore 7. Each arm is movable between: (i) an active position (FIG. 3) in which this cutting end 13 is distant from the hollow body 1, in order to effect an enlarging of the hole; and (ii) an inactive position (FIG. 2) at least close to, flush with, and/or recessed with respect to the external periphery of the hollow body 1. The other end 17 of the arm 11, inside the hollow body 1, is intended to receive from a drilling fluid, in circulation in the hollow body 1, a pressure capable of pushing the said arm into its active position in FIG. 3.

FIGS. 2A–B shows for this purpose that each arm 11 is provided with a circular peripheral groove 19 intended to receive a sealing joint. The said joint could however be disposed in a groove cut in the wall of the bore 7, or sleeve 63, which will be described later in more detail, with regard to FIG. 8. In either case, this groove can be cut in a plane perpendicular to each common axis 9, as shown in FIG. 2. The groove could, however, be cut in a plane which would be perpendicular to a plane comprising the longitudinal axis 3 and the common axis 9, and which would at the same time be parallel to the aforementioned longitudinal axis 3, forming an ellipsoidal joint designed for this purpose.

The configuration of arms 11, bores 7 and any grooves/seals disposed therebetween provides for a generally fluid tight seal between arms 11 and bores 7, while allowing arms 11 to slide with respect to cylindrical body 1 and/or sleeves 63. Accordingly, in accordance with a particular embodiment of the present invention, little to no additional pressure drop is introduced into longitudinal, central bore 18, due to the installation of underreamer 10 upon drill strings 6 and 8. Furthermore, underreamer 10 of the present invention is configured to accommodate a relatively high flow rate of drilling fluid during operation.

According to a particular embodiment of the invention, the underreamer has, for locking the widening arms 11 in the inactive position, a locking member 21 common to all the arms 11. This common locking member 21 is arranged so as to occupy a locking position (FIG. 2) in which it locks the arms 11 in their inactive position. It is designed to be immobilized in the hollow body 1, in a releasable manner, in the said locking position, principally before use of the underreamer. When it is released, the locking member 21 can leave the locking position under a thrust of at least one of the arms 11 subjected to the pressure capable of pushing the said arm 11 into its active position (FIG. 3).

To keep the locking member 21 as mentioned releasably in its locking position, it can be fixed to the hollow body 1 (FIG. 2) by a breakable pin (e.g., shear pin) 23, calibrated for this purpose in accordance with the said given fluid pressure threshold. This type of calibration of a shear pin is known to persons skilled in the art. In the illustrated embodiment, a single shear pin is used to secure locking member 21 in place, and therefore to control the respective positions of each locking arm. However, additional shear pins may be used, in accordance with other embodiments of the present invention.

As shown by FIGS. 2A–B and 3, a circular groove 25 is fashioned in the locking member 21 so as to entirely receive one end 27 of the breakable pin 23. This end 27 is connected to the remainder of the breakable pin 23 by means of an area with a reduced cross-section 29 formed so as to attain the aforementioned calibration. The said remainder of the pin 23 is generally fitted in the hollow body 1. In this manner, a single shear pin may be used to form the releasable coupling between the locking member and cylindrical body 1. However, in alternative embodiments, multiple retaining pins may be used for this purpose. Hollow body 1 has, for receiving the breakable pin 23, a housing 31 opening out on the external periphery of the body 1, and closed for example by a plug 33 to be screwed or fixed by any other appropriate means.

Any unlocking movement of and by the locking member 21 can be envisaged. In the illustrated embodiment, however, locking member 21 is arranged so as to slide axially in the hollow body 1, from its locking position, under the thrust of the arms 11 and for it to have, seen along its axis and on the side of the arms 11, an end face 35 which co-operates with a support face 37 of each arm 11 for the locking thereof.

The direction in which the arms 11 move can be any direction, within the teachings of the present invention. However, in the illustrated embodiment, axis 9 of the arms 11 intersects the longitudinal axis 3 of the hollow body 1 and, starting from this longitudinal axis 3, for it to be either perpendicular thereto, or rather inclined in the direction of drill string 6 that is fixed upstream, in a direction S. The locking member 21 is then situated upstream of the arms 11 and slides upstream in order to release arms 11.

The inclination of the arms 11 towards string 6, around 60 degrees with respect to the longitudinal axis 3 (in the illustrated embodiment), procures, with respect to a perpendicular direction between the axes 9 and 3, a surface of the cutting end 13 which is greater and therefore more space for blades 15 and/or diamonds and/or other cutting elements. For the purposes of this specification, "upstream" refers to the direction of travel within the bore hole which leads to the surface of the wellbore.

In a variant, the end face 35 of the locking member 21 can have, for each arm 11, a frustoconical support surface hollowed in the locking member 21 and determined by a rectilinear generatrix. The latter, starting from the periphery of the locking member 21 and returning to this, intersects the longitudinal axis 3 at an acute angle of for example 75 degrees. From this position, this generatrix can be moved in rotation about the longitudinal axis 3. This angle of 75 degrees, or a close value, proves beneficial for helping to return the arms 11 to their inactive position as explained below.

In another variant, the said generatrix which forms the support surface can be moved parallel to itself in a plane perpendicular to the plane which it forms with the longitudinal axis 3, so as therefore to form on each occasion a flat support surface. In the case of this other variant, it is helpful to prevent, by normal means, a rotation of the locking member 21 about the longitudinal axis 3.

Figure 4A:
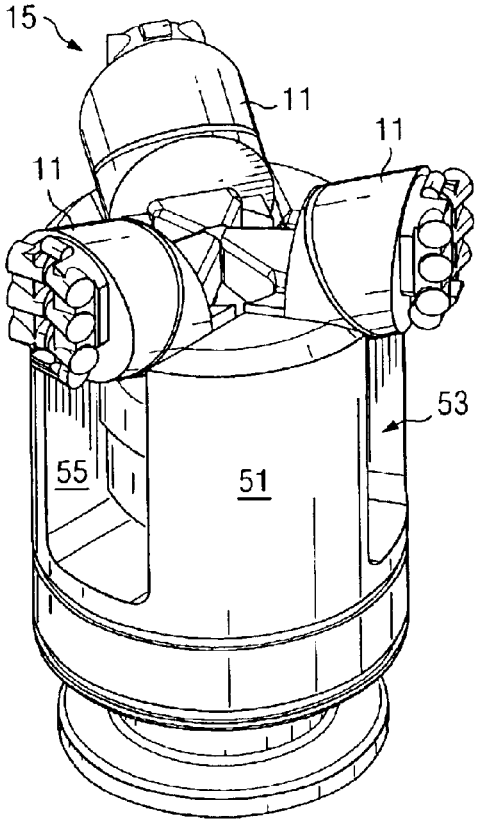
FIGS. 4A–4C illustrate cutting arms of the underreamer, disposed within a mandrel configured to slidably receive the cutting arms.
Figure 4B:
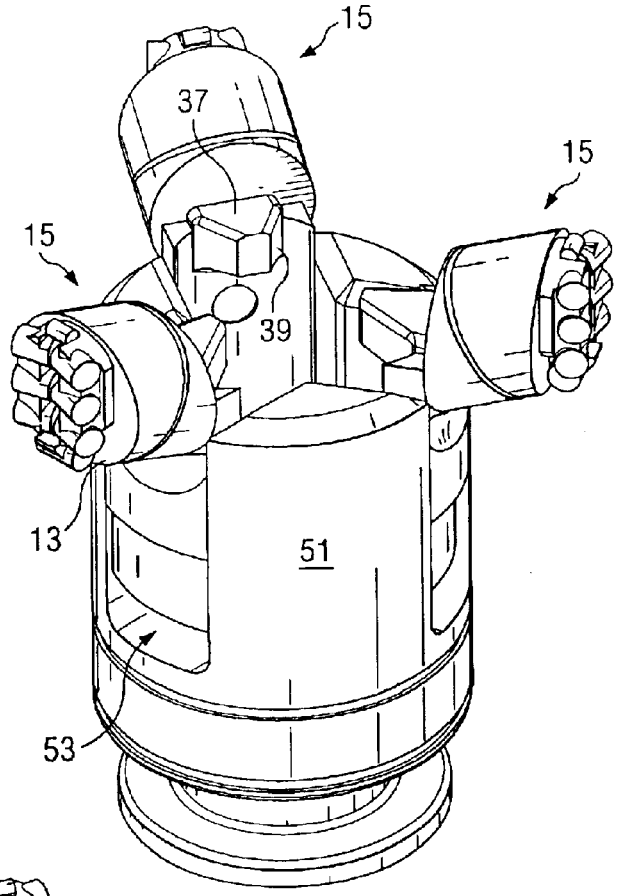
Figure 4C:
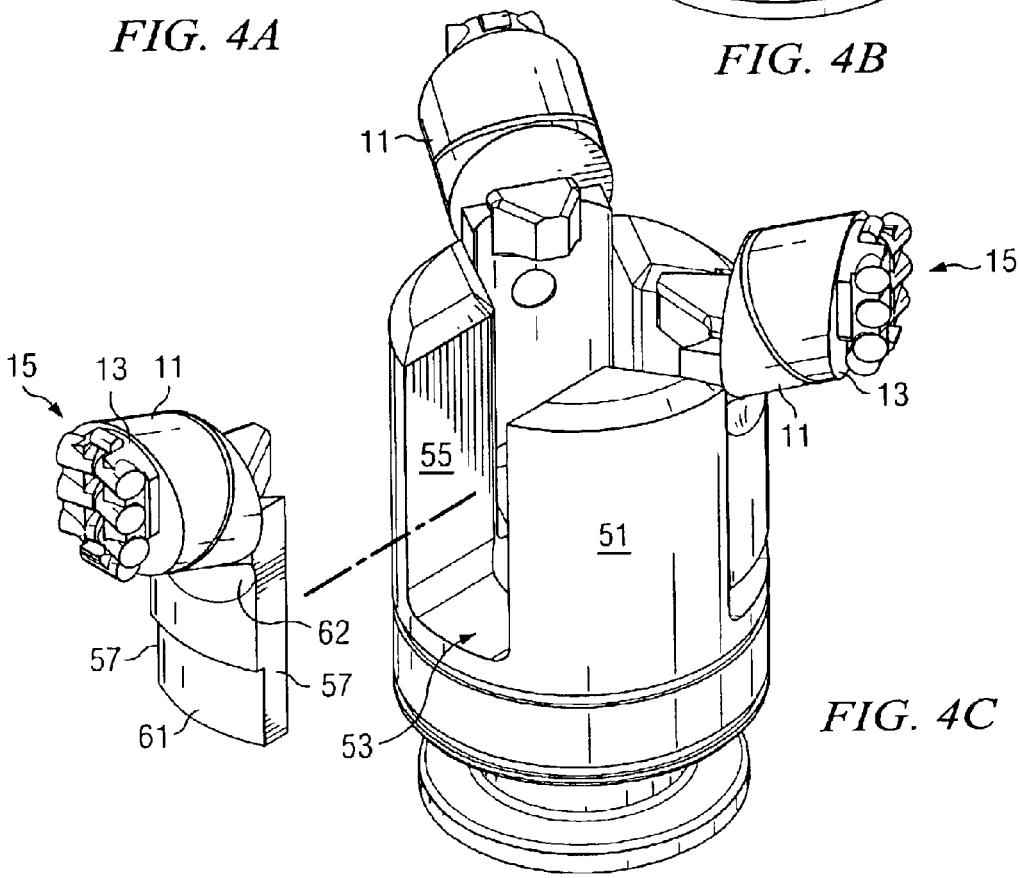

In the illustrated embodiment of FIGS. 4A–4C, the support face 37 of each arm 11 is fashioned on a projection 39 thereon so as to present, in the mounted state of the arm 11 in the hollow body 1, a complementary shape and an inclination substantially identical to those of the support surface of the end face 35 of the locking member 21. The orientation of surfaces 35 and 37 are selected such that force upon surface 37 that is translated from spring 41, through surface 35, directs the cutting arms back into their recessed position. Accordingly, surface 37 is tapered upward, along its surface from the cutting end 13 of arm 11, towards longitudinal axis 3. Surface 35 has a corresponding shape to accommodate "mating" of the two surfaces. In a particular embodiment, the degree of taper of surface 37 is configured such that surface 37 forms an angle of approximately 45 degrees with longitudinal axis 3. It will be recognized that such angle could have practically any value, from approximately 0 to approximately 90 degrees. It is currently contemplated that such angle will fall in the range of 30 degrees to 60 degrees for many applications.

Protrusions 39 are arranged so as to partially close off, in the inactive position of the arms 11, the passage of the fluid in the body 1 and thus to produce a detectable pressure difference in the fluid compared with that which is established when the arms 11 are in the active position. This can be used as a signal for indicating to the operator the position of the arms 11.

To prevent a rotation of an arm 11 about its axis 9, and thereby wrong orientation of the cutting elements 15 which it carries at its cutting end 13, there exist various means. For example, provision can in particular be made, for the aforementioned projection 39 of each arm 11 to have two lateral faces which are parallel to each other and to a plane formed by the common axis 9 and the longitudinal axis 3. These lateral faces extend between the support face 37 and the remainder of the arm 11 over a length corresponding to the relative movements between the locking member 21 and each arm 11. Then, on each side of the said corresponding support surface of the locking member 21, there are provided on the latter two parallel guidance faces arranged in the same way to cooperate with the two lateral faces of the projection 39. An arrangement of this type simultaneously prevents rotation of the locking member 21 about the axis 3.

Underreamer 10 of FIGS. 2A–B and 3 includes a prestressed spring system 41, in particular a compression spring 41, arranged to bear on the hollow body 1 in order to return the arms 11 to the inactive position. As can be seen in FIGS. 2A–B and 3, this spring system 41 advantageously acts on the arms 11 by means of the locking member 21 in order to return them to the inactive position. A person skilled in the art understands that the force deployed by such a spring 41 (approximately 825 kilos in the illustrated embodiment because of the space available for a particular model of underreamer) is relatively small compared with that produced by a pressure of the fluid, for example around 50 to 100 bars, which for this model gives an order of magnitude of 1.4 to 2.8 tonnes on each arm 11.

To put the aforementioned underreamer, lowered into the bore hole, into action at the required time, the operator increases, up to the said threshold, or beyond, the pressure of the fluid in the string which carries this underreamer. The fluid at this pressure acts on the other ends 17 of the arms 11 by means of which it produces a force which each arm 11 then applies to the locking member 21. The latter acts on the breakable pin 23 calibrated so as to break, at the point of the reduced area 29, as from a force corresponding to the said pressure threshold. The detached end 27 of the pin 23 remains in the circular groove 25 while the remainder of pin 23 remains in the housing 31. The locking member 21 thus released releases the arms 11 which, under the pressure of the fluid, execute a piston movement and their cutting ends 13 can go to the active position as they cut into the formation around.

When the pressure of the fluid in the hollow body is sufficiently reduced, the spring system 41 pushes the locking member 21 which, through its end face 35, pushes on the support faces 37 of the arms 11 and thus returns these to the inactive position. If then the underreamer is taken up again, it is possible to remove from the housing 31 the part of the breakable pin 23 which is situated therein and to introduce therein a new complete pin 23. The end 27 of the broken pin is able to remain stored in the circular groove 25, without interfering, until dismantling is required either for maintenance or for repair of the underreamer, or because the circular groove 25 contains too many ends of this type.

It is also clear from an examination of FIGS. 2A–B and 3 that, when the pressure of the fluid pushes the arms 11 into the active position and therefore these push the locking member 21 and compress the spring 41, one or two of the arms 11 can hold the spring 41 completely or partially compressed whilst the other one or others, subjected for example to a reaction from the formation, may return inside the body 1 whilst having to overcome only the said pressure: there is not in the illustrated underreamer a rigid connection between the arms 11, obliging them to be irremediably in the active position altogether in the event of an excessive force on one of them. Persons skilled in the art know and understand themselves the advantages of this mounting and will thus find that an arm 11 with too much force on it can retract before being damaged, if the operator complies with a maximum applied pressure.

Given the particular arrangement of the locking member 21 and of the spring 41, there can easily be provided a tool arranged to bear on the said body 1 and to move the arms 11 away from the spring system 41, in particular by means of and with the locking member 21. This tool can, according to its design, be introduced to one or other end of the underreamer and, according to circumstances, pull or push on the locking member 21 in order to compress the spring 41.

It is possible easily to provide in addition a removable stop means which is arranged to temporarily hold the spring system 41 away from the arms 11, in particular by means of the locking member 21. This removable stop means can consist of a suitable rod which is introduced into the aforementioned housing 31, in place of the breakable pin 23, when a second circular groove 43 fashioned on the locking member 21 is positioned, in particular by means of the aforementioned tool, facing the said housing 31.

The underreamer according to the invention may be particularized compared with those known from the state of the art by a choice of the inside and outside diameters of the hollow body 1, of an axial length of the arms 11 and of their shape enabling the complete arms 11 to be installed in their respective bores 7 by passing through the inside of the hollow body 1. In particular, there is provided for this purpose in one end of the body 1, preferably on the downstream side because of the arrangement of the constituent parts, a threaded hole 45 with a diameter greater than the diameter of the external thread 47 at the end of the body 1 on the upstream side. It is then possible to provide an adaptation piece 49 with a male thread for this threaded hole 45 and with a female thread matching the said external thread 47, for connecting a bit to the underreamer in the usual manner for example.

It is however possible to fix directly, without the adaptation piece 49, in the threaded hole 45 with a greater diameter, a drilling bit whose end with a male thread is chosen accordingly. For this purpose, this threaded hole 45 preferably has a dimension which is standard in the industry, or the male thread on the bit is adapted to the threaded hole 45.

In accordance with another embodiment of the present invention, a plurality of underreamers may be "stacked"

upon one another and used in combination for drilling operations. In this embodiment, adaptation piece 49 would not be required. Instead, a second underreamer similar or identical in configuration to underreamer 10, may be removably attached to underreamer 10. By doing so, the underreamer may be used to perform underreaming operations independently of one another, increasing the ability and capacity to enlarge the wellbore. Furthermore, additional underreamer may be coupled with this combination, such that three or more underreamers may be used independently but in combination to perform underreaming operations.

As shown in FIGS. 2–4C, the underreamer of the invention can have an internal piece 51 removably fixed in the hollow body 1, downstream of the arms 11, and having, on the side turned towards the arms 11, for each of these, a guidance groove 53 (FIGS. 4A–4C) with two sides 55 preferably parallel, parallel to the longitudinal axis 3. The sides 55 are arranged to cooperate with two parallel edges 57 carried by each of the arms 11, in order to prevent rotation thereof about their axes 9. The dimensions of these sides 55 and edges 57 are chosen according in particular to the travel of the arms 11 between the active and inactive positions. The internal piece 51 is held in the body 1 for example by three pegs 59 (FIG. 2). The two parallel edges 57 carried by an arm 11 can be fashioned on a lug 61 (FIGS. 2, and 4A–4C) which the said arm has and which extends downstream, parallel to the longitudinal axis 3.

As illustrated in FIG. 4C, lug 61 includes a reduced diameter portion 62 near the cutting end of enlarging arm 11. The reduced diameter portion 62 forms a "dished out" region where material is removed, to allow for a void that may be filled with fluid, during operation. The reduced diameter portion, as well the presence of the fluid, reduces the amount of friction between lug 61 and external wall 5, during drilling operations while the enlarging arms 11 are in an extended position. The reduced diameter portion is tapered to accommodate a smooth transition along lug 61. Lug 61 also includes a reduced diameter portion at a lower end thereof, adjacent the reference number 61 of FIG. 4C.

Figure 8:
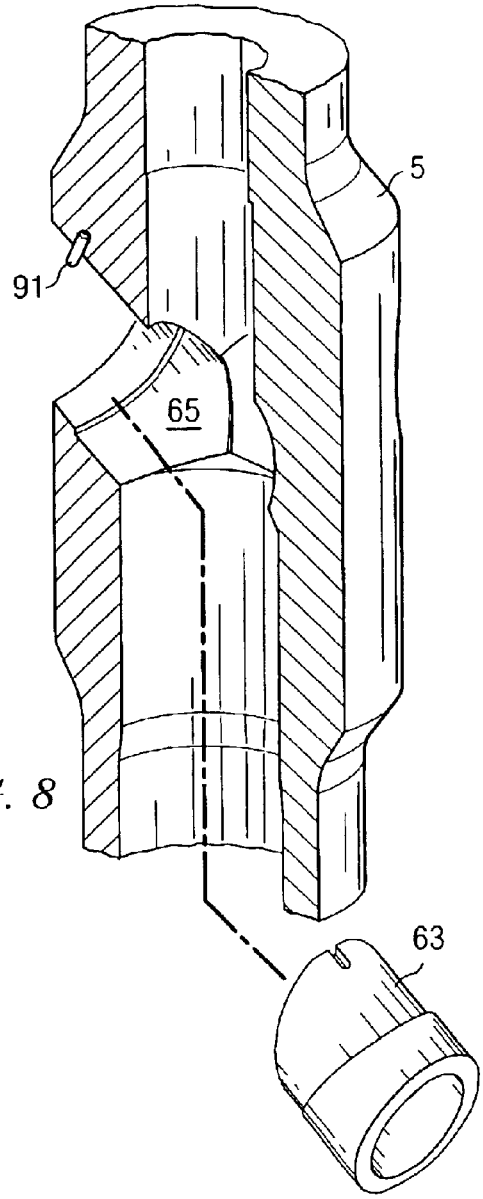
FIG. 8 illustrates a generally cylindrical sleeve for installation in the underreamer of FIG. 1, in accordance with a particular embodiment of the present invention.

As shown in FIGS. 2, 3 and 8, each of the bores 7 is fashioned in a sleeve 63 made from high-strength metal (e.g., toughened steel, etc), fashioned in the hollow body 1. FIGS. 2A–B and 3 illustrate the mounting of the sleeves 63 in their housings 65. As can be seen, each have at their interface two diameters and therefore at 89 (FIG. 2), in the housing 65, a shoulder to which a rim on the sleeve 63 corresponds, the largest diameter being disposed on the internal side of the underreamer. The sleeve 63 is then introduced into its housing 65 from the inside of the underreamer. Any adhesive possibly used to fix the sleeve 63 is then not subjected to any force along the axis thereof, this force being absorbed by the above-mentioned shoulder and rim. An alignment pin 91 (FIG. 2) previously fixed in the housing 65 can cooperate with a groove cut in the outside of the sleeve 63 in order to indicate the correct positioning thereof in its housing 65.

Thus the underreamer of the invention can have, downstream of the arms 11, a valve seat intended to receive a ball, for example launched via the drill string, in order to reduce at a chosen moment the cross-section of the passage available for the fluid and thus to increase the pressure of the fluid on the arms 11, in particular to hold them in the active position during widening whilst moving upstream.

In this context, it will be noted that the orientation of the arms 11 pointing substantially upstream (FIG. 2) is favorable to a natural thrust of the formation of the arms 11, during the raising of the underreamer without fluid pressure, and helps them to retract into the body 1 should something prevent them from this. In addition, the said orientation of the arms 11 pointing substantially upstream is also favorable to their emergence from the body 1 in order to adopt their active position since a force component in this direction occurs, along the axis 9, because of the "Weight on Bit" (WOB).

Figure 5:
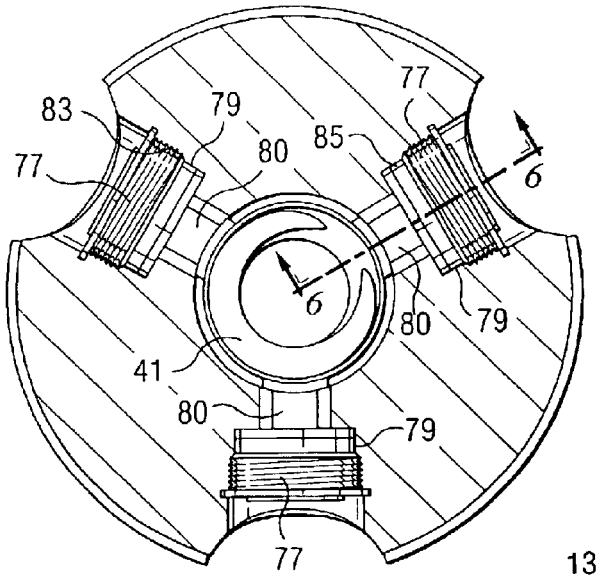
FIG. 5 illustrates a longitudinal cross section through the underreamer.

In accordance with another embodiment of the present invention, FIGS. 2, 3 and 5–7 illustrate a plug 77 fixed to the hollow body 1. Plug 77 protects a stop 79. As shown by FIG. 5, three adjustable stops 79 (or two or more) and their respective plugs 77 can be provided at the same level in the hollow body 1.

Figure 6:
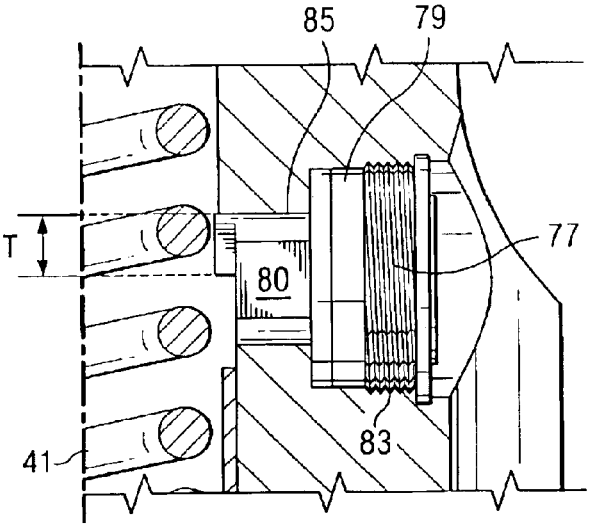
FIG. 6 is a partial cross section, with portions broken away, through the section 6—6 of FIG. 5.
Figure 7:
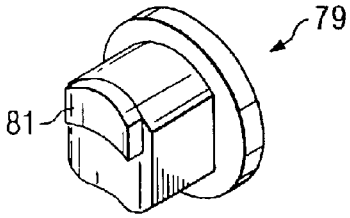
FIG. 7 illustrates a stop having a protrusion extending therefrom, in accordance with a particular embodiment of the present invention.

The function of these adjustable stops 79 is to limit the travel of the locking member 21 in the direction of a compression of the spring 41 and consequently to limit the emerging travel of the widening arms 11 under the thrust of the fluid. For this purpose, as shown in FIGS. 5–7, each stop 79 has a projection 81 arranged so as to project in a predetermined, controlled manner into the chamber in which the locking member 21 slides. This projection 81 can be adapted for thickness T in order to obtain this said emerging travel of the arms 11. The end, pointing towards the axis 3, of the projection 81 is advantageously in the form of an arc of a circle (FIG. 6) aligned on the axis 3 in order to offer to the locking member 21 a large support surface. For example, various sets of three stops 79 having in each case the same thickness T for one set and different thicknesses from one set to another can be supplied with the underreamer of this embodiment of the invention.

The thickness T, that is selected for any particular application will at least partially control the extent of travel of the locking member within the longitudinal bore, and therefore, determine the ultimate maximum extended position of the arms. In this manner, the stops may be configured such that a predetermined extension of the cutting arms is preselected. In accordance with a particular embodiment, the predetermined extension of the cutting arms will not vary with fluid pressure. Instead, an operator can select the radial extension of the arms, by selecting a particular thickness T, for any given application. Furthermore, the position of the stop prevents spring 41 from being fully compressed, which protects spring 41 and prolongs its service life.

FIGS. 5 and 6 show on the one hand the bore 83 for the plug 77 and on the other hand the passage 85 adjusted for the adjustable stop 79. This passage 85 has for example a trapezoidal transverse section, like the one depicted, corresponding to the same section of the portion 80 of the adjustable stop 79. In consequence, the latter can be placed only in a given orientation in the passage 85, and in this way the projection 81 is necessarily and unavoidably positioned each time at the correct place in the travel of the locking member 21.

In FIGS. 2A–B and 3 locking member 21 includes a recessed portion, or cavity 87 for centering the spring 41. Cavity 87 retains the spring at least partially therein, and prevents the decoupling of spring 41 and locking member 21. The rim of this cavity 87 can then be the element of this member 21 which will abut against the adjustable stop or stops 79. Accordingly, the thickness of the stop and the configuration of locking member 21 cooperate to determine the diameter to which enlarging arms 11 will extend, during operation.

A valve seat 93 may be carried, on the upstream side, by the locking member 21. Should one of the arms 11 be locked in the emerged position and not return under the action of the spring 41, it is possible to throw from the surface, in the string, a suitable ball (not shown) which will close this valve seat 93. The pressure, possibly increased, of the fluid on the ball and on the locking member 21 increases the chance of releasing the arm or arms 7 and therefore recovering the underreamer in an at least relatively good condition.

FIG. 8 illustrates the configuration of sleeve 63 and housing 65, in more detail. The shoulder that is formed by the reduced diameter portion of the opening in housing 65 co-operates with a corresponding shoulder, or protrusion of sleeve 63, to prevent sleeve 63 from being forced outward, beyond an installed position.

Figure 9:
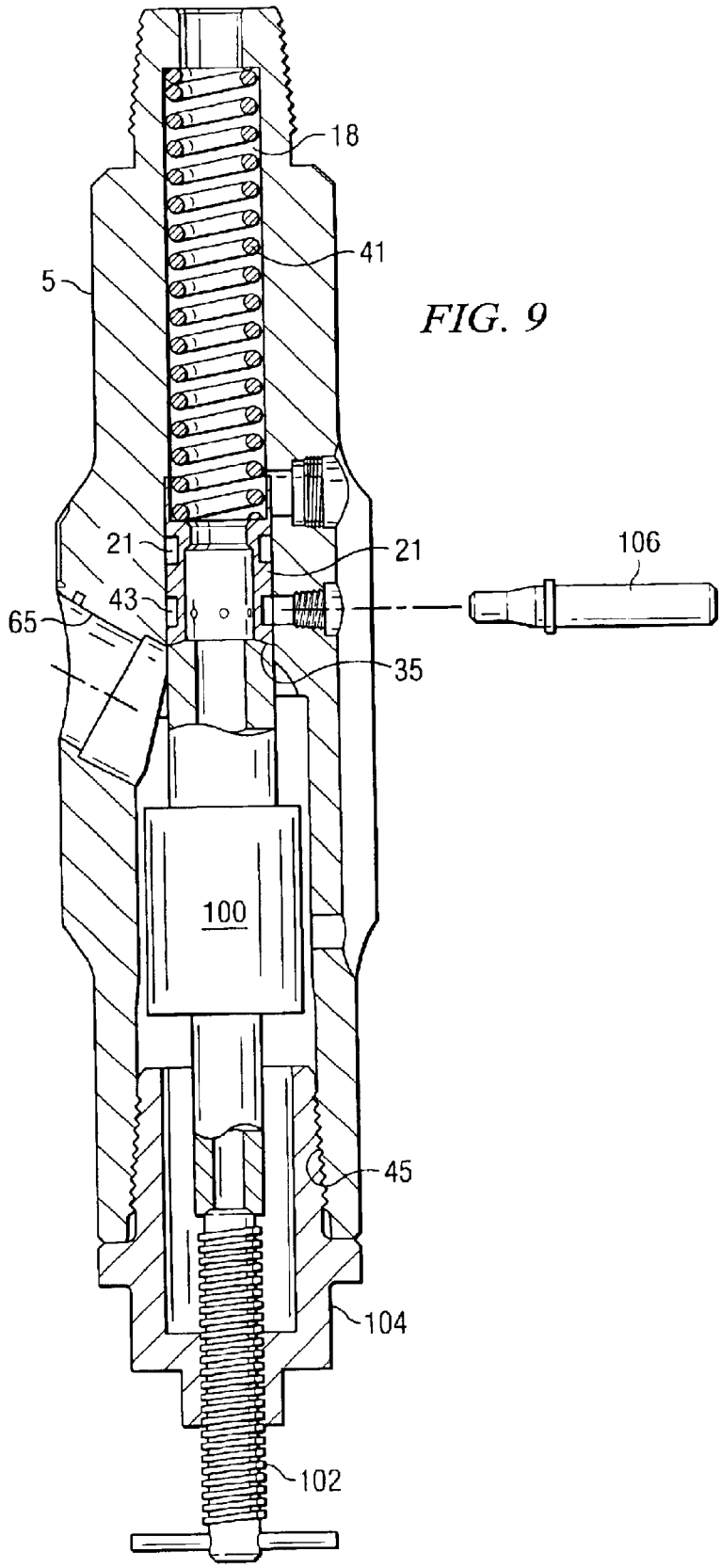
FIG. 9 is a schematic drawing, with portions broken away, illustrating components used for the assembly of the underreamer, in accordance with a particular embodiment of the present invention.

FIG. 9 illustrates tools and components that may be used during assembly of underreamer 10. In order to install arms 11, a tool 100 is used to compress spring 41, to a degree sufficient to allow access and clearance of sleeves 63. A central screw 102 of tool 100 is used to engage components of underreamer 10 and compress spring 41. A threaded cap 104 forms a removable coupling between tool 100 and underreamer 10. When tool 100 has compressed spring 41 by a sufficient amount, a pin 106 is inserted through housing 31 and engages an assembly groove of locking member 21. Accordingly, components of underreamer 10, including spring 41, are maintained safely in place to allow for the installation and assembly of all components.

Although the present invention has been described by several embodiments, various changes and modifications may be suggested to one skilled in the art. It is intended that the present invention encompass such changes and modifications as fall within the scope of the present appended claims.

| Legend to the FIGS. | |
|---|---|
| S | direction of drilling/of fluid |
| 1 | cylindrical body |
| 2 | casing |
| 3 | longitudinal axis |
| 4 | concrete |
| 5 | external wall |
| 6 | drill string |
| 7 | Peripheral bores |
| 8 | drill string |
| 9 | axes (peripheral bore) |
| 10 | underreamer |
| 11 | enlarging arm |
| 12 | bore hole |
| 13 | cutting end |
| 14 | terrestrial formation |
| 15 | Blades |
| 16 | drill head |
| 17 | end (of 11) |
| 18 | central bore |
| 19 | peripheral groove (of 11) |
| 21 | locking member |
| 23 | breakable pin |
| 25 | circular groove |
| 27 | end (of 23) |
| 29 | reduced cross-section (of 23) |
| 31 | housing |
| 33 | plug (shear pin) |
| 35 | end face |
| 37 | support face |
| 39 | projection (of 11) |
| 41 | prestressed spring |
| 43 | groove (of 21) |
| 45 | threaded hole |
| 47 | external thread |
| 49 | adaptation piece |
| 51 | internal piece |

-continued

| Legend to the FIGS. | |
|---|---|
| 53 | guidance groove |
| 55 | sides |
| 57 | parallel edges (of 11) |
| 59 | pegs (of 51) |
| 61 | lug (of 11) |
| 62 | reduced diameter portion (of 61) |
| 63 | sleeve |
| 65 | housing (of 63 in 1) |
| 67 | screw (for 63) |
| 69 | protrusion (on 11) |
| 77 | other plug or plugs |
| 79 | adjustable stop or stops |
| 80 | portion of 79 |
| 81 | projection of 79 |
| 83 | bore for 77 |
| 85 | adjusted passage for 79 |
| 87 | cavity in 21 for 41 |
| 89 | location of shoulder in 65 |
| 91 | pin (in 65) |
| 93 | valve seat in 21 |

What is claimed is:

1. An underreamer, comprising;

an elongate, generally cylindrical body defining a longitudinal bore at least partially therethrough, and at least first and second peripheral bores extending generally from the longitudinal bore to an external surface of the body;

at least first and second cutting arms being disposed at least partially within the first and second peripheral bores, respectively;

each cutting arm being extendible from a first position in which the cutting arm is generally flush or recessed with respect to the external surface, and a second position in which the cutting arm is extended with respect to the external surface; and a removable stop being disposed within a cavity that extends generally from the external surface to the longitudinal bore, the removable stop extending at least partially into the longitudinal bore and being operable to limit longitudinal movement of the cutting arms beyond a maximum extended position of the cutting arms.

2. The underreamer of claim 1, further comprising a locking member being removably coupled with the body, the locking member being disposed at least partially within the longitudinal bore and including a first surface configured to limit longitudinal movement of the cutting arms beyond the first position, unless a fluid pressure within the longitudinal bore exceeds a predetermined maximum value.

3. The underreamer of claim 2, wherein the stop is configured to limit longitudinal movement of the locking member when the cutting arms are actuated from the first positions to the second positions, and the first surface thereby limits the longitudinal movement of the cutting arms beyond the maximum extended position of the cutting arms.

4. The underreamer of claim 2, further comprising a breakable pin disposed within a bolt hole that extends generally from the external surface to the longitudinal bore, the breakable pin being operable to form the removable coupling between the body and the locking member unless the predetermined maximum value of the fluid pressure is exceeded.

5. The underreamer of claim 4, wherein the locking member includes a generally cylindrical configuration, the locking member having a groove formed on an outer surface of the locking member, the groove being operable to receive an end of the breakable pin at least partially therein.

6. The underreamer of claim 5, wherein the breakable pin includes a reduced thickness portion being calibrated to fracture if the predetermined maximum value of the fluid pressure is exceeded.

7. The underreamer of claim 2, wherein respective first and second axes of the peripheral bores intersect a central axis of the longitudinal bore and each axis of the peripheral bores is either perpendicular with the longitudinal bore or inclined upstream with respect to the longitudinal bore.

8. The underreamer of claim 7, wherein the locking member is situated upstream with respect to portions of the cutting arms that are disposed at least partially within the longitudinal bore, and the locking member is operable to slide longitudinally upstream as the locking arms are actuated from the first positions to the second positions.

9. The underreamer of claim 1, wherein each of the cutting arms includes a respective cutting end having cutting elements disposed thereupon.

10. The underreamer of claim 1, further comprising a biasing element being disposed at least partially within the longitudinal bore and being operable to urge the cutting arms toward the first position.

11. The underreamer of claim 10, further comprising a locking member disposed between the biasing element and the cutting arms, the locking member being operable to translate a force from the biasing element to the cutting arms.

12. The underreamer of claim 11, wherein the stop includes a protrusion that extends at least partially into the longitudinal bore, the protrusion having a predetermined thickness, which at least partially determines the maximum extended position of the cutting arms.

13. The underreamer of claim 1, wherein each cutting arm includes a protrusion that extends at least partially into the longitudinal bore, the protrusions cooperating to form a substantially reduced diameter portion of the longitudinal bore, when the cutting arms are in their respective first positions.

14. The underreamer of claim 1, further comprising a mandrel being disposed at least partially within the longitudinal bore at a location downstream of the cutting arms, the mandrel having a generally cylindrical body forming a plurality of slots being configured to receive correspondingly shaped portions of the cutting arms at least partially therein.

15. The underreamer of claim 14, further comprising at least one non-rotation pin extending through the external wall and cooperating with the mandrel to prevent axial rotation of the mandrel within the longitudinal bore, and thereby prevent axial rotation of the cutting arms.

16. The underreamer of claim 1, wherein a well tool is removably coupled with the underreamer, such that the well tool and the underreamer may be used independently and in combination for underreaming operations, the well tool being selected from the group consisting of underreamers and stabilizers.

17. The underreamer of claim 11, wherein the locking member includes a plurality of support surfaces, each support surface being configured to receive a respective one of the cutting arms, and wherein each support surface is formed by a projection of a rectilinear generatrix.

18. The underreamer of claim 11, further comprising a tool configured to bear on an interior surface of the cylindrical body and operable to urge the biasing element away from the cutting arms when the tool is in an installed position.

19. The underreamer of claim 1, further comprising a valve seat disposed down hole from the cutting arms, the valve seat being configured to receive a ball at least partially therein, to thereby increase a fluid pressure upon the cutting arms.

20. A well tool, comprising;

an elongate, generally cylindrical body defining a longitudinal bore at least partially therethrough, and at least first and second peripheral bores extending generally from the longitudinal bore to an external surface of the body;

at least first and second arms being disposed at least partially within the first and second peripheral bores, respectively;

each arm being extendible from a first position in which the arm is generally flush or recessed with respect to the external surface, and a second position in which the arm is extended with respect to the external surface; and a removable stop being disposed within a cavity that extends generally from the external surface to the longitudinal bore, the removable stop extending at least partially into the longitudinal bore and being operable to limit longitudinal movement of the arms beyond a maximum extended position of the arms.

21. The well tool of claim 20, wherein the well tool comprises a stabilizer, and the arms comprise stabilizer arms.

* * * * *